US005335039A

United States Patent [19]

Muller et al.

[11] Patent Number: 5,335,039

[45] Date of Patent: Aug. 2, 1994

[54] APPARATUS FOR PROCESSING PHOTOSENSITIVE MATERIAL

[75] Inventors: Bruce R. Muller, Rochester; Douglas O. Hall, Canandaigua; David G. Sherburne, Ontario; Thomas W. Glanville, Churchville, all of N.Y.

[73] Assignee: Eastman Kodak Company, Rochester, N.Y.

[21] Appl. No.: 956,136

[22] Filed: Oct. 2, 1992

[51] Int. Cl.[5] ..... G03D 3/02; G03D 13/02

[52] U.S. Cl. ..... 354/324; 354/331; 354/336

[58] Field of Search ..... 354/319-324, 354/331, 336; 134/64 P, 64 R, 122 P, 122 R

[56] References Cited

U.S. PATENT DOCUMENTS

| | | | |
|---|---|---|---|
| 3,299,792 | 1/1967 | Nardone et al. | 95/89 |
| 3,648,593 | 3/1972 | Marshall | 98/115 R |
| 4,989,028 | 6/1991 | Hall et al. | 354/324 |
| 4,994,840 | 2/1991 | Hall et al. | 354/324 |
| 5,059,997 | 10/1991 | Hall et al. | 354/324 |
| 5,093,678 | 3/1992 | Muller et al. | 354/324 |

*Primary Examiner*—D. Rutledge
*Attorney, Agent, or Firm*—Dana M. Schmidt

[57] ABSTRACT

An improvement in an apparatus for processing photosensitive materials. The apparatus includes a processing chamber through which the material can be advanced for processing the material. The processing chamber has an entrance at one end and an exit at the other end to allow the photosensitive material to travel through the chamber. The apparatus further includes a tank for holding a processing fluid. At least one nozzle assembly is provided for supplying processing fluid from the tank to the processing chamber. The nozzle assembly comprises an outer nozzle secured to the tank and an inner nozzle secured to the upper tank. The inner and outer nozzles are spaced apart a predetermined distance so as to form a discharge opening therebetween which is in fluid communication with the processing fluid in the tank so as to create a first fluid layer on one side of the photosensitive material passing through the processing chamber. The inner and outer nozzles have a configuration designed to maintain the predetermined distance between the inner and outer nozzles substantially constant along the length of the discharge opening.

30 Claims, 9 Drawing Sheets

APPARATUS FOR PROCESSING PHOTOSENSITIVE MATERIAL

FIELD OF THE INVENTION

The present invention relates to an apparatus for processing photosensitive materials, such as sheets of x-ray film.

BACKGROUND OF THE INVENTION

The present invention is directed to a processing apparatus of the type which includes upper and lower tanks for holding a processing fluid and a narrow processing chamber located between the tanks through which a sheet of photosensitive material is advanced for processing of latent images on the photosensitive material. Processing fluid is delivered to opposite sides of the photosensitive material from each of the tanks through an elongated discharge opening for forming a fluid layer on each side of the photosensitive material. A return drain is provided on each side of the photosensitive material for removing and returning the processing fluid to the sump tank. Example of such devices are illustrated in U.S. Pat. No. 4,989,028; U.S. Pat. No. 4,994,840; and U.S. Pat. No. 5,059,997. Such devices are often referred to as fluid suspension processors.

In order to obtain high velocity fluid streams from the discharge openings on to the photosensitive material, it is necessary to provide a thin uniform discharge opening. Prior art devices have had to employ costly manufacturing materials and techniques in order to obtain uniform fluid streams. Typically, prior art devices have had to use rigid metal parts in order to obtain the uniform fluid streams which not only add to the cost of the device but also add significantly to the weight of the device thus making it more difficult to service and repair. Prior art devices have also been difficult to assemble and disassemble. The fluid forces acting on the parts also make it more difficult to maintain uniform fluid streams. The thermo cycling experienced by the device further adds to the difficultly in maintaining uniform spacing of the discharge opening. During the course of a typical day, the device will go through various standby cycles in addition to being turned on and off at least once which causes significant temperature increases and decreases to occur in the device. This repeated thermo cycling makes it difficult to maintain a uniform spacing in the parts that form the fluid stream over an extended period of time. The effects of thermo cycling are even more difficult to resolve when plastic materials are employed to make the parts that form the discharge openings.

The present invention is directed to a fluid suspension processor which provides uniform thin discharge of processing fluid which can be easily manufactured, assembled or disassembled, and can be made of non rigid plastic material thereby permitting the utilization of low cost materials and manufacturing techniques.

SUMMARY OF THE INVENTION

The present invention relates to an improvement in an apparatus for processing photosensitive materials. The apparatus includes a processing chamber through which the material can be advanced for processing the material. The processing chamber has an entrance at one end and an exit at the other end to allow the photosensitive material to travel through the chamber. The apparatus further includes a tank for holding a processing fluid. At least one nozzle assembly is provided for supplying processing fluid from the tank to the processing chamber. The nozzle assembly comprises an outer nozzle secured to the tank and an inner nozzle secured to the tank. The inner and outer nozzles are spaced apart a predetermined distance so as to form a discharge opening therebetween which is in fluid communication with the processing fluid in the tank so as to create a fluid layer on one side of the photosensitive material passing through the processing chamber. Means are provided for maintaining a uniform discharge opening between the inner and outer nozzles along the length of the discharge opening.

BRIEF DESCRIPTION OF THE DRAWINGS

In the Detailed Description of the Preferred Embodiment of the invention presented below reference is made to the accompanied drawing, in which.

DETAILED DESCRIPTION OF THE PREFERRED EMBODIMENT

Figure 1:
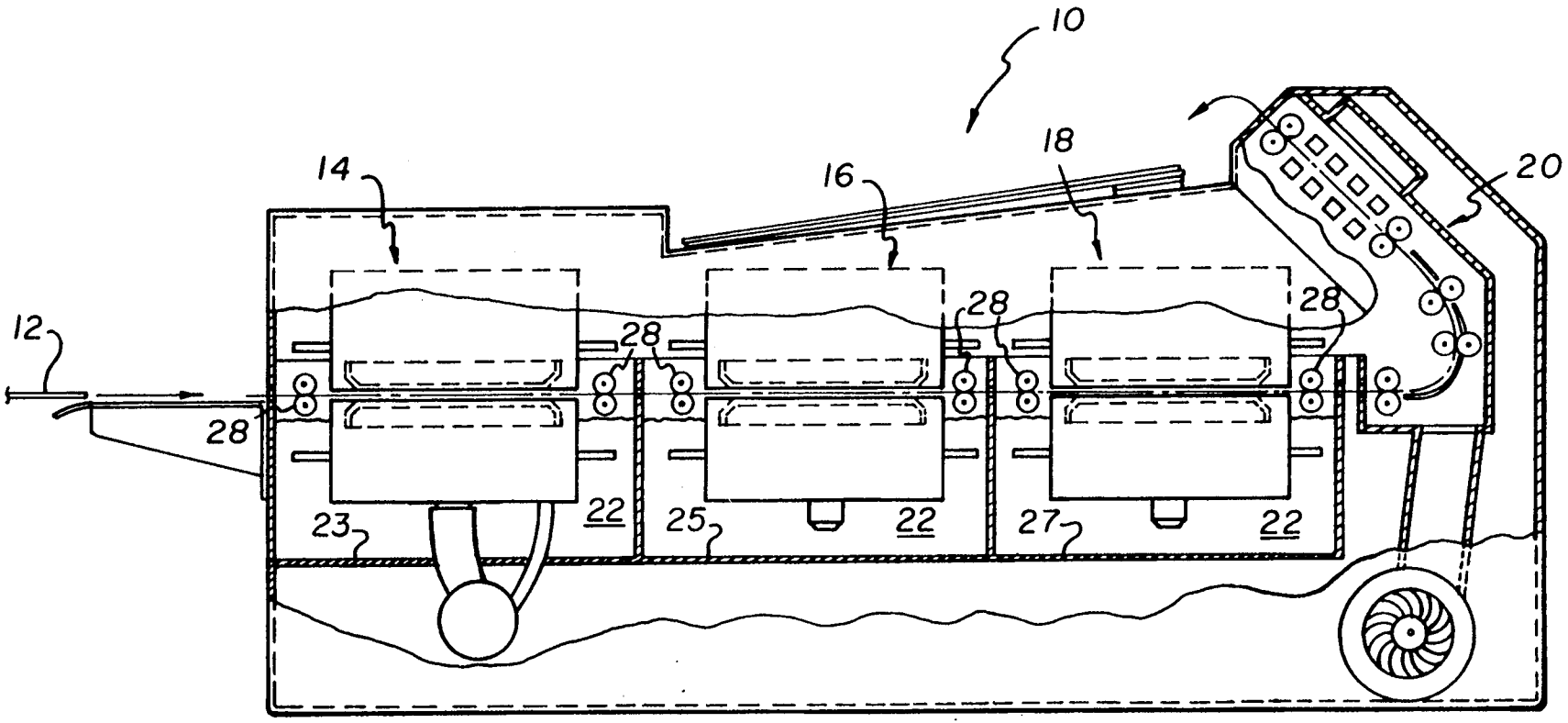
FIG. 1 is a cross-sectional view of a photographic processing apparatus made in accordance with the present invention.
Figure 2:
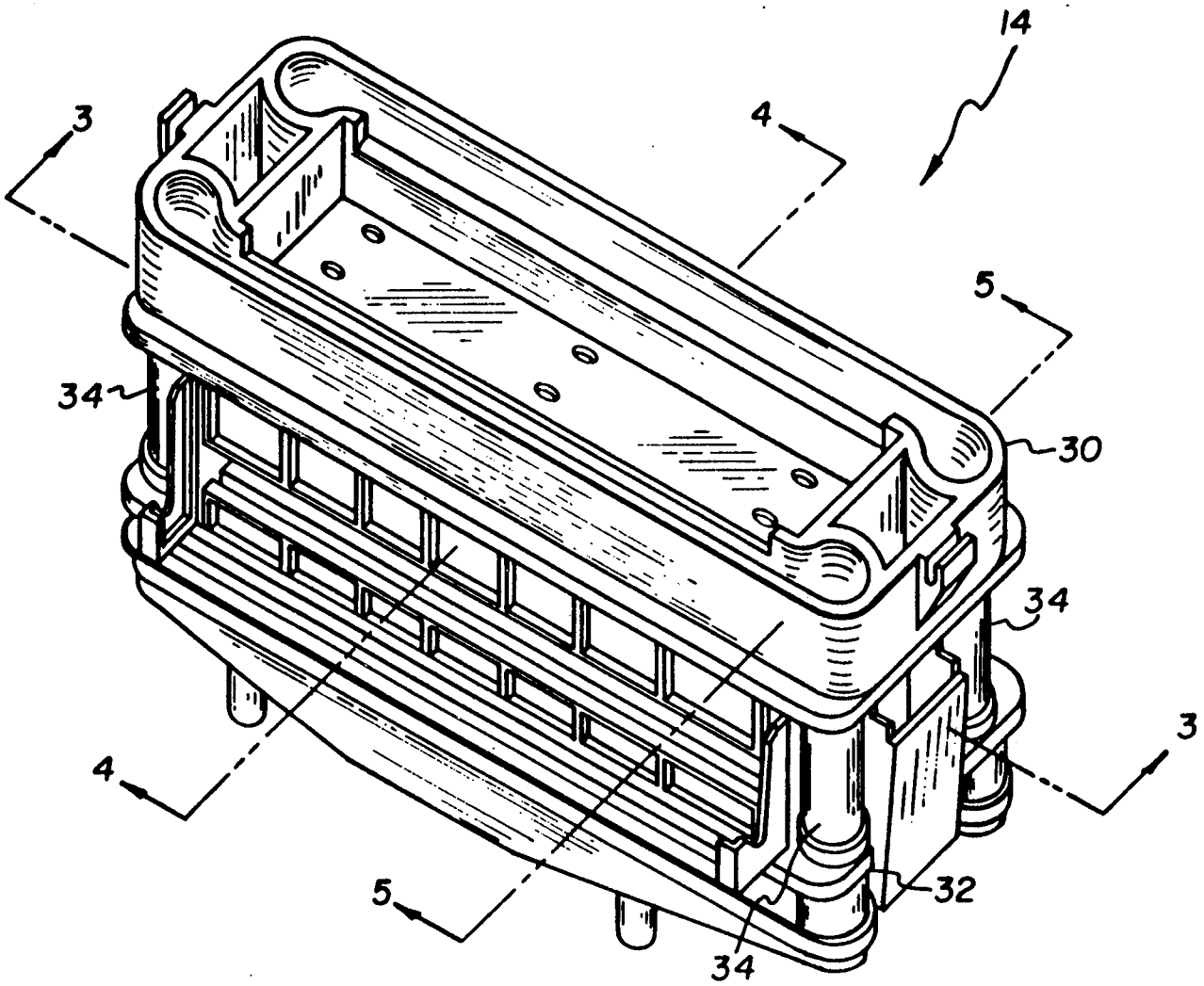
FIG. 2 is perspective view of one of the processing units of the processing apparatus of FIG. 1.
Figure 3:
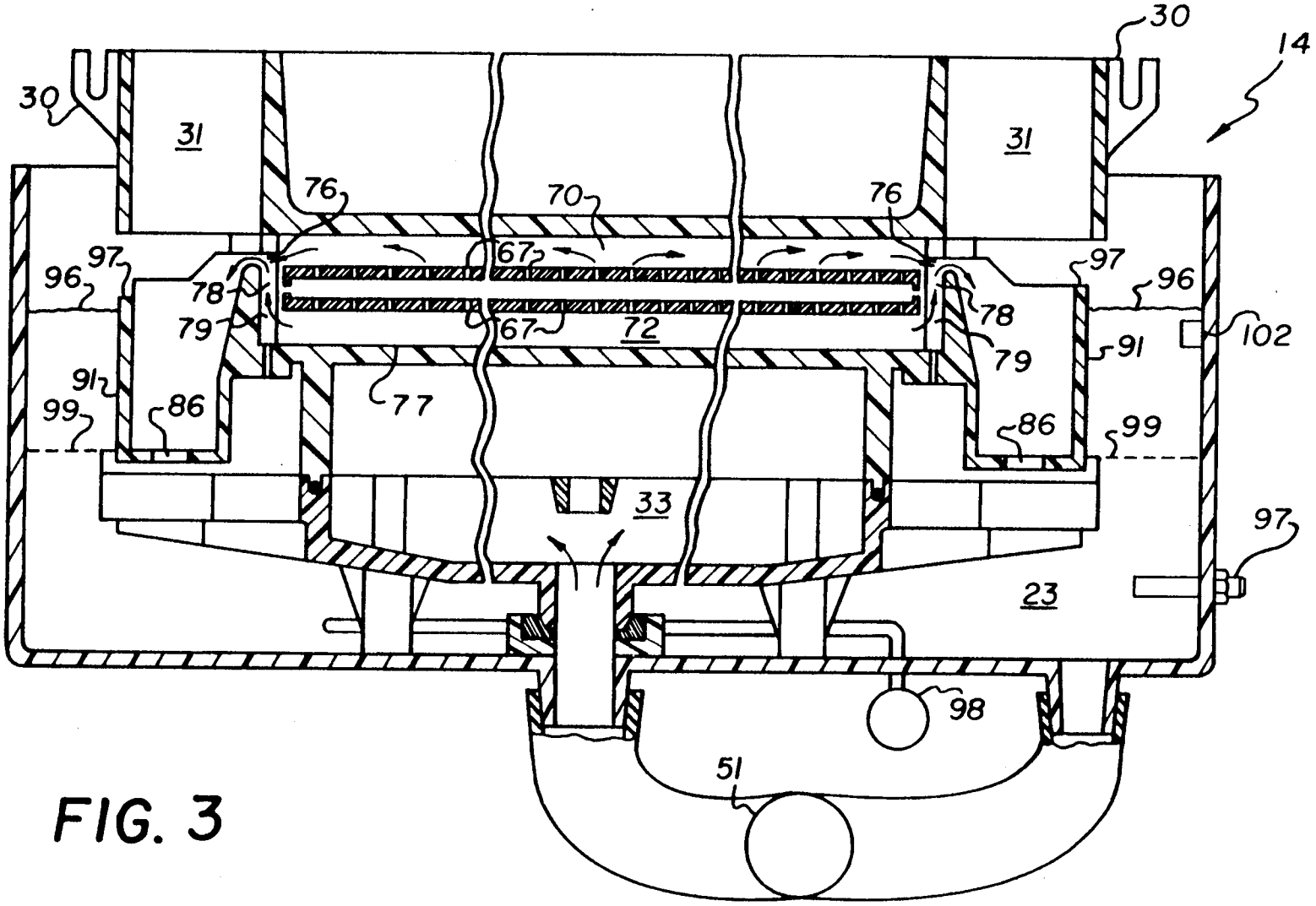
FIG. 3 is a cross-sectional view of the processing unit of FIG. 2 taken along line 3—3.
Figure 4:
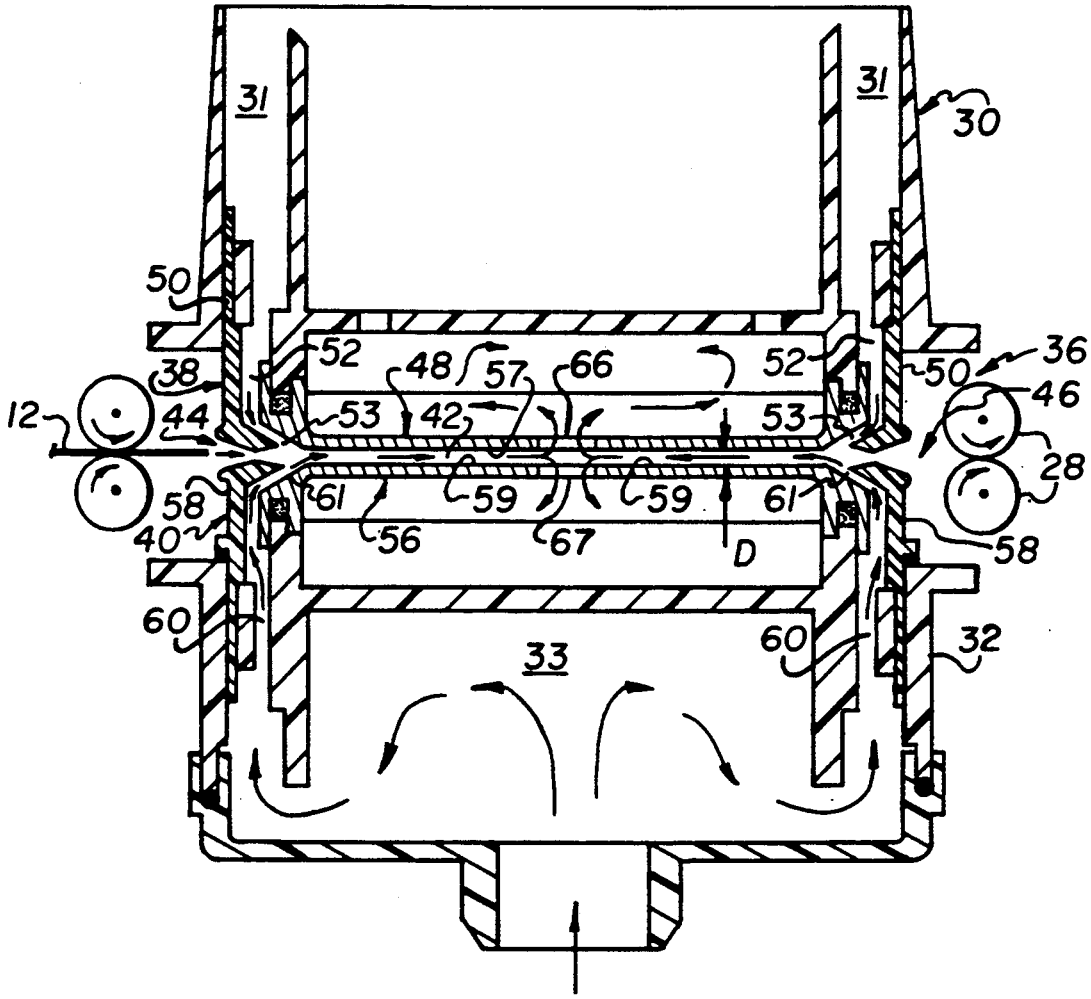
FIG. 4 is a cross-sectional view of processing unit of FIG. 2 as taken along line 4—4.
Figure 5:
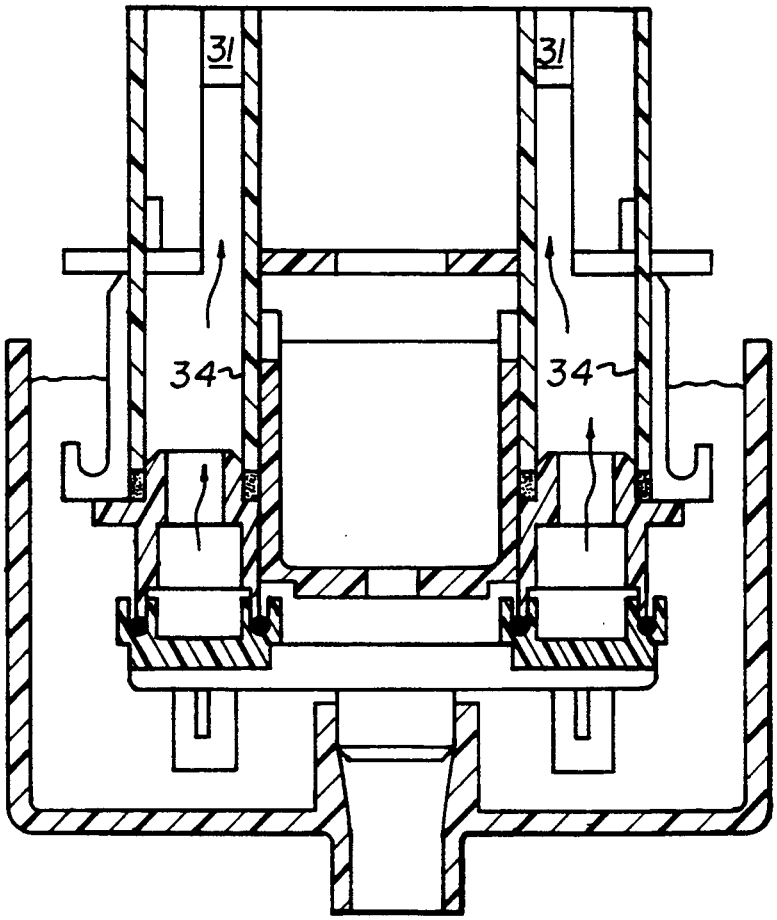
FIG. 5 is a cross-sectional view of the processing unit of FIG. 2 as taken along line 5—5 illustrating how the fluid passes from the lower tank to the upper tank.

FIG. 1 of the drawings illustrates a photographic processing apparatus made in accordance with the present invention, generally designated 10, that is useful for processing a strip or sheet of photosensitive material 12 (film, paper or other suitable material). The photographic processing apparatus 10 includes a plurality of photographic processing units, three of which are shown at 14, 16 and 18. A processing fluid 22 is supplied to each unit. The processing fluid 22 is generally in a liquid form and includes such photographic processing liquids as developer, fixer, bleach, rinsing fluid, water, or any other fluids for use in the processing of photosensitive material. Any number of photographic processing units can be included in the photographic process apparatus 10 depending upon the number of processing fluids required for processing a specific photosensitive material. The processor may of course include other elements typically found in processors. For example, a dryer 20 may be provided for drying of the photosensitive material. Additionally a processing unit made in accordance with the present invention may be combined with other conventional processing units as desired.

A plurality of sump tanks 23,25,27 for holding a processing fluid are provided for units 14, 16, 18, respectively. The photosensitive material 12 is conveyed through the apparatus by a plurality of nip rollers 28 associated with the photographic processing units 14,16,18. The rollers 28 can be driven by any conventional drive means (not shown).

The photographic processing units 16, 18 are the same or similar in construction to the photographic processing unit 14. Therefore only processing unit 14 will be discussed in detail it being understood that the other processing units are similarly constructed. Referring to FIGS. 2–6 processing unit 14 comprises an upper tank 30 and a lower tank 32 having retention chambers 31, 33, respectively, for holding a processing fluid 22. Four connecting tubes 34 (as best seen by reference to FIG. 5) connect the retention chambers 31, 33 of tanks 30 and 32 so as to allow processing fluid 22 to flow freely between the upper tank 30 and lower tank 32. The processing unit 14 further includes a processing section 36 located between the upper tank 30 and lower tank 32. The processing section comprises an upper nozzle assembly 38 associated with the upper tank 30 and a lower nozzle assembly 40 associated with lower tank 32. The upper and lower nozzle assemblies 38, 40 define a narrow processing fluid processing chamber 42 through which the photosensitive material 12 travels during processing. The chamber 42 has an entrance 44 through which the photosensitive material enters the chamber 42 and an exit 46 through which the photosensitive material leaves the chamber 42. The upper nozzle assembly 38 includes an inner nozzle 48 mounted to the bottom of tank 30 and a pair of outer nozzles 50 secured to upper tank 30. The inner and outer nozzles 48, 50 define a pair of passage 52 which are in processing fluid communication with the retention chamber 31 of the upper tank 32 and an discharge opening/outlet 53 which extends along substantially the entire length of the tank 30 for dispensing of the processing fluid into chamber 42. The outlet 53 allows processing fluid 22 to enter chamber 42 and forms a first fluid layer on one side of the photosensitive material 12. The inner nozzle 48 comprises a substantially flat central section 57 which forms the top of chamber 42.

The lower nozzle assembly 40 includes an inner nozzle 56 mounted to the bottom of tank 30 and a pair of outer nozzles 58 secured to lower tank 30. The inner and outer nozzles 56, 58 define a pair of passage 60 which are in fluid communication with the retention chamber 33 of the lower tank 32 and a pair of discharge openings/outlets 61 for dispensing of the processing fluid into chamber 42 so as to form a second fluid layer on the opposite side of the photosensitive material 12. The inner nozzle 56 comprises a substantially flat central section 59 which forms the bottom of chamber 42. The flat sections 57,59 of inner nozzles 48, 56, respectively, form the narrow processing chamber 42. The flat sections 57, 59 are spaced apart a distance D such that the substantially narrow processing chamber 42 allows the photosensitive material 12 to easily pass therebetween and form a thin fluid processing layer on each side of the photosensitive material. In the particular embodiment illustrated the distance D is about 0.125 inches (0.3175 cms) and is designed to receive a film having a thickness of about 0.007 inches (0.0175 cms).

Figure 7:
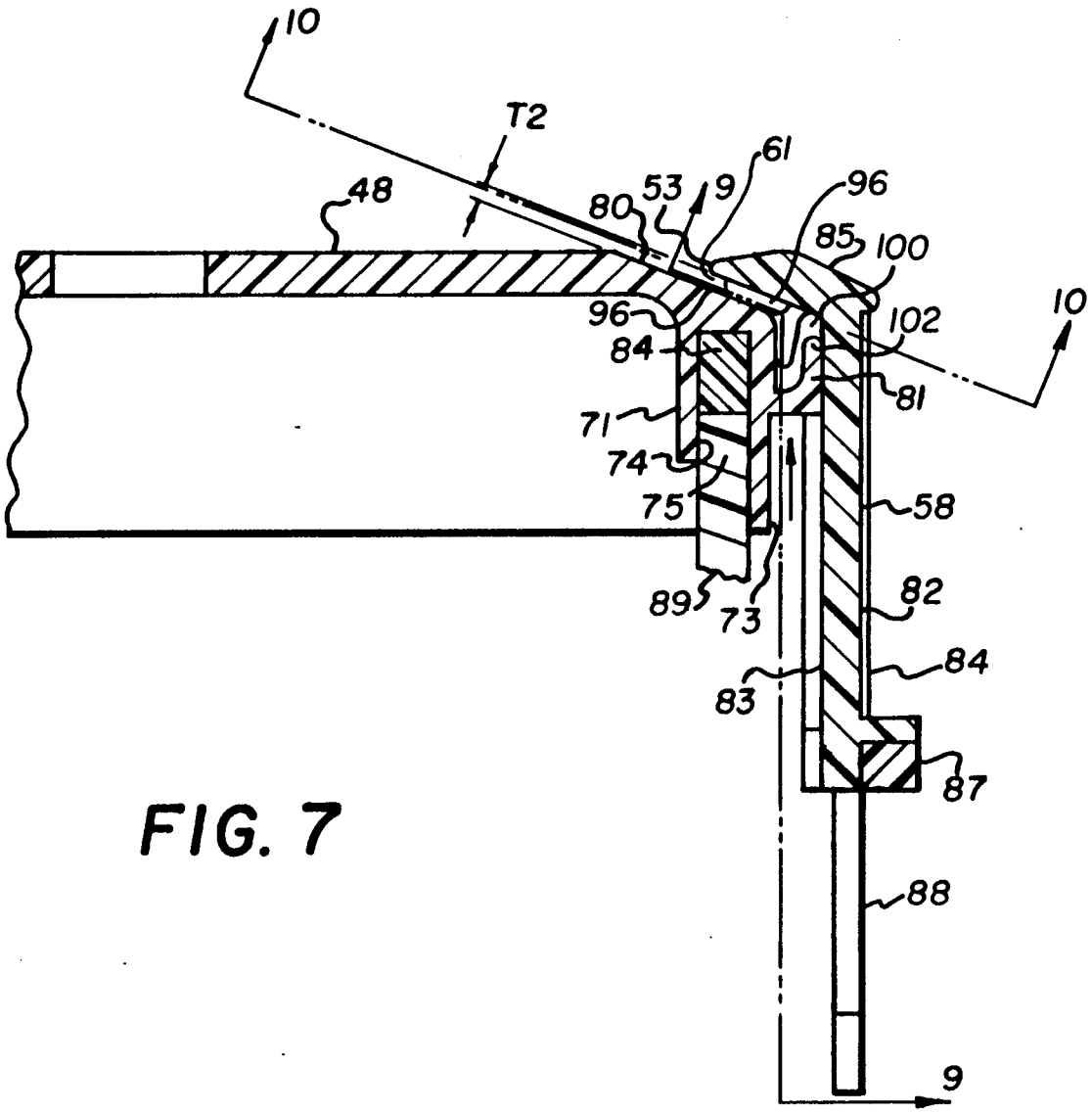
FIG. 7 is an enlarged partial cross sectional view of the inner nozzle and one of the associated outer nozzles.

Preferably as illustrated the inner and outer nozzles 48,50,56,58 and tanks 30,32 are made of a plastic material so as to reduce the manufacturing cost of the processor. The tanks, inner nozzles and outer nozzles are preferably injection molded and made of an ABS (acrylonitrile butadiene styrene) plastic as is readily available in the market place. In the particular embodiment illustrated, the tanks are made of Cycloac SBK and the inner and outer nozzles are made of a polyphenylene oxide plastic (Noryl 731) both sold by General Electric Plastics. However any suitable plastic may be used. In order to maintain the photosensitive material in a stable position in chamber 42 it is important the processing fluid flowing out of outlets 53,61 be substantially uniform along the length. Therefore it is very important that the spacing of outlets 53,61 be held substantially constant during use of the processor, including during any thermo cycles the device may experience. Accordingly, it is also important that no relative movement take place between the inner and outer nozzles as this can affect the uniformity of the processing fluid flowing therethrough. The inner and outer nozzles are designed to be secured to its associated tank so that a substantially constant size discharge opening 53,61 is maintained along the length thereof. Both inner nozzles 48,56 are secured to their respective tanks in the same manner, therefore only a description of how one of the inner nozzles is secured to its associated tank will be discussed, it being understood that the other inner nozzle is secured in a similar manner. Referring to FIG. 7, there is illustrated an enlarged view of one side of inner nozzle 56 and how it is secured to tank 32. The other side of inner nozzle 56 being secured in like manner. In particular, each side of inner nozzle 56 is provided with a pair of spaced side walls/projections 71,73 located at the entrance 44 and exit 46 of the chamber 42 each forming a receiving slot 74 for receiving the terminal end 75 of the adjacent side wall 89 of tank 32. Side walls 71, 73 are spaced apart so that the inner nozzle 56 can easily slide with respect to the adjacent sidewall 89 of the tank. The adjacent outer nozzle applies a restraining force against the inner nozzle so as to maintain it in engagement with its associated tank. A strip 84 made of resilient material is located within each of the slots 74. The strip 84 provides the inner nozzle with certain degree of flexibility which assist in maintaining a substantially uniform spacing in the adjacent outlet 61 by providing a biasing force between the inner and outer nozzles along the length of the outlets 61. In the particular embodiment illustrated he strip 84 is made of a closed cell compliant foam. An example of a suitable foam is Poron foam which may be purchased from the Rogers Corporation. However any suitable foam may be used.

Along the outer surface of the sidewall 73 of inner nozzle 56 there is provided a plurality of axially spaced projecting members 81 which are designed to engage the adjacent outer nozzle and assists in providing uniform spacing with the adjacent outer nozzle and prevent relative rotation/pivoting between the inner and outer nozzles. In the particular embodiment illustrated, the projecting member 81 is integrally formed as a part of the inner nozzle. As best seen by reference to FIG. 7, an angled planar surface 80 is provided on the inner nozzle 56 which forms one side of the adjacent outlet 61.

Figure 8:
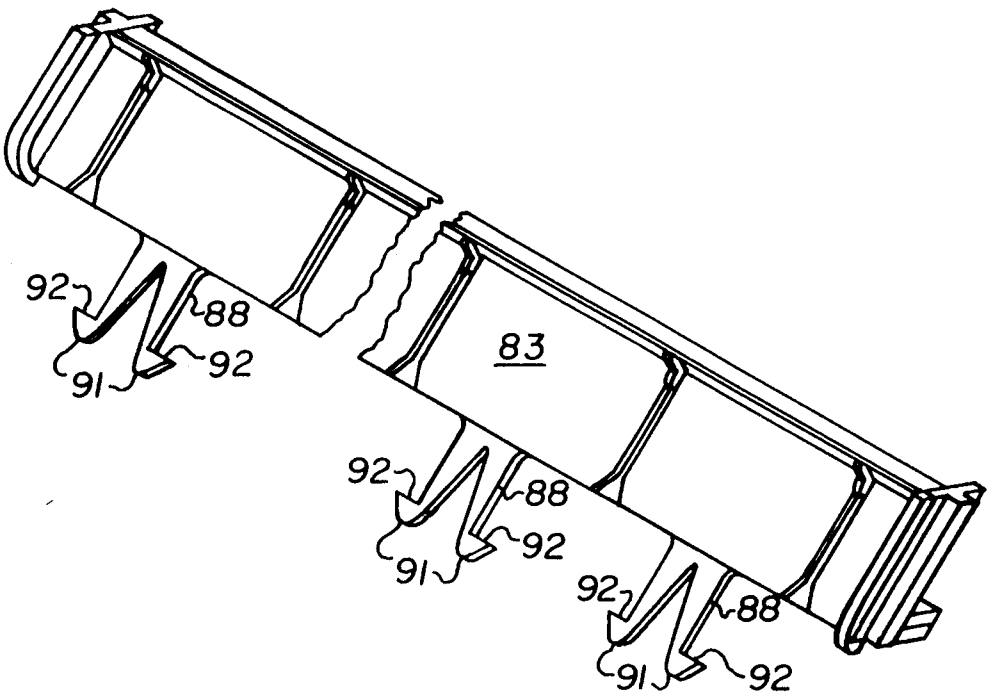
FIG. 8 is a perspective view of the outer nozzle illustrated in FIG. 7.
Figure 9:
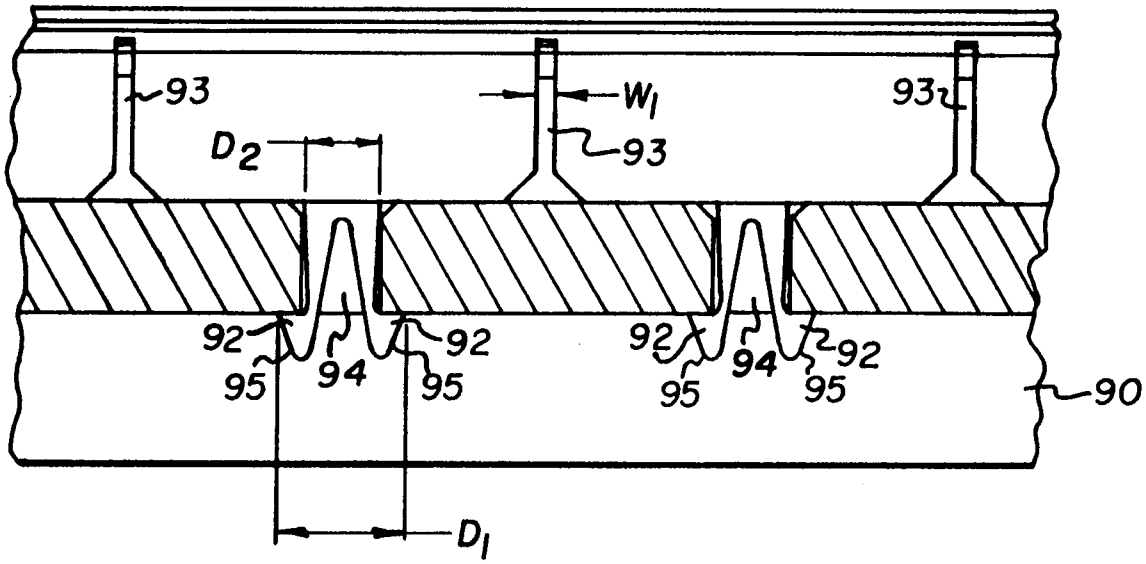
FIG. 9 is a side elevation view of a portion of the outer nozzle as taken along line 9—9 of FIG. 7 illustrating how the outer nozzle is mounted to the associated tank.
Figure 10:
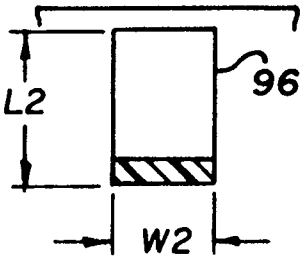
FIG. 10 is a partial greatly enlarged view of the outer nozzle as taken along line 10—10 of FIG. 7 illustrating one of the projections used to maintain the spacing of the discharge opening.

The outer nozzles 58 each comprise a central section 82 having inside surface 83 and outside surface 84, a discharge section 85 and a plurality of snap finger assemblies 88 which secure the outer nozzle to the outer wall 90 of the tank. In the particular embodiment illustrated the snap finger assemblies 88, as best seen by reference to FIGS. 8 and 9, each comprise a pair of legs 91 which are capable of flexing a sufficient amount so that they can pass through an opening 94 provided in outer wall 90 of tank 32. The legs 91 each have a projecting section 92 which provide and overall width D1 to the legs 91 in the non-deflected condition which is greater than the width D of opening 93 which it must pass through. The legs 91 are designed so the legs 91 flex together so that they can pass through opening 94 and will go back to its non deflected condition after it passes through the opening 94. To install outer nozzle to the tank the snap finger assemblies are aligned with its associated opening 94. The outer nozzle is moved toward the tank which causes cam surfaces 95 to ride in opening 94 causing the legs 91 to deflected as they pass through the opening 94 until the projection section 92 passes through opening 94 which then allows the legs 91 to go to their normal position and permit the top of projection sections 92 to mate with the ledge formed in outer wall 90. To remove outer nozzle, the legs 91 are simply moved toward each other so that the finger assemblies can be removed therethrough. A cushion strip 87 is provided between the outer nozzle and it associated tank. Strip 87 is preferably made of the same material from which strip 84 is made.

The inside surface 83 of outer nozzle 58 is provided with a plurality of grooves 93 which have a width W1 designed to receive projecting member 81. The discharge section 85 extends toward the inner nozzle 56 and has planar surface 95 which is substantially parallel to surface 80 of inner nozzle and forms the other portion of outlet 61. A plurality of spaced projections 96 are provided on the inner surface of the discharge section for maintaining the spacing of outlet 61. A sufficient number of projections 96 are provided so that a substantially constant size outlet 61 will be maintained along the length thereof. In the particular embodiment illustrated seven (7) projections 96 equally spaced are provided along the nozzle. In the particular embodiment illustrated, the projections are axially spaced apart a distance of about 3 inches (7.62 cms). The width W2, length L2 and thickness T2 of projections 96 are selected as necessary to meet the design requirements. In the particular embodiment illustrated projections 96 each have a width W2 of about 0.070 inches (0.1778 cms), a length L2 of about 0.070 inches (0.1778 cms) and a thickness T2 of about 0.025 inches (0.0635 cms). The projections 96 form a recess 100 with the adjacent wall which is designed to receive the terminal end 102 of the associated projections 81 so as to resist relative rotation between the inner and outer nozzles. When the outer nozzle 58 is in its fully seated position in tank 32, a restraining force is applied against the adjacent inner nozzle 48 through projections 96. Since the inner nozzle 48 is free to move with respect to tank 32 and the strips 84,87 apply a biasing force between the inner and outer nozzles, the inner nozzle is free to float with respect to the tank and thus allow the inner and outer nozzles to maintain a substantially constant discharge opening therebetween. As the processor experiences various fluid flow pressures and various temperature gradients, the inner and outer nozzles will automatically self adjust to maintain a substantially constant spacing at the discharge opening. In the preferred embodiment illustrated the inner nozzle is free to move with respect to the tank, however, the present invention is not so limited. If desired, the outer nozzle may be made to move and the inner nozzle may be relative fixed.

Figure 11:
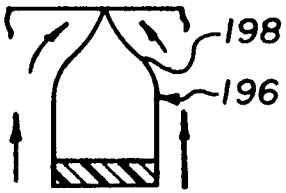
FIG. 11 is a view similar to FIG. 10 illustrating a modified projection.

In order to minimize any interference to the uniform fluid stream, the projections 96 may have streamlined configurations. Referring to FIG. 11 there is illustrated a modified projection 196 having a streamlined configuration. The projection 196 has a terminal end 198 designed to minimize the disturbance to the fluid flowing out of the discharge opening. In the illustrated the terminal end 198 has a generally curved arrow shape. However, it is to be understood that the terminal end may have any other shape so desired. Additionally the streamlined configuration may be provided at both the top and bottom ends if so desired.

Figure 6:
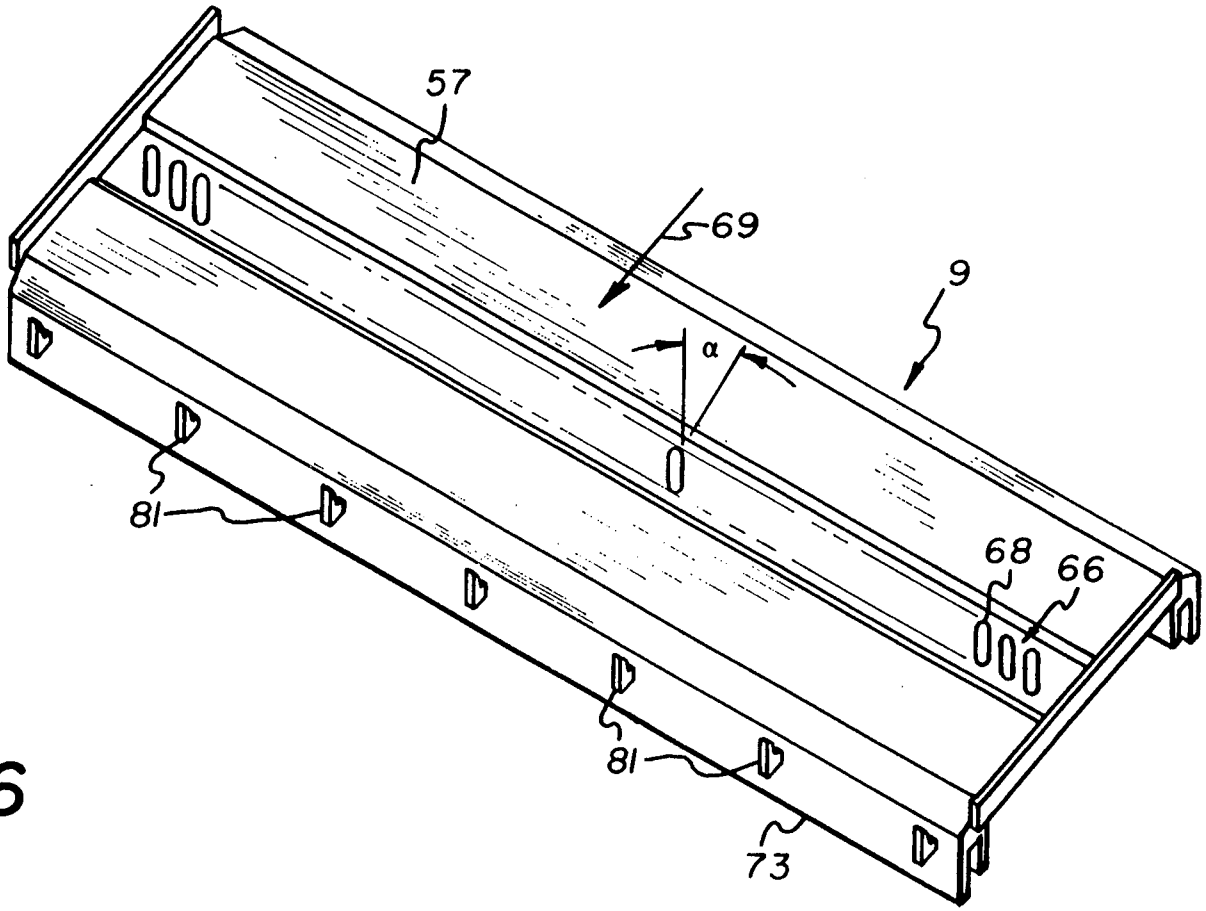
FIG. 6 is a perspective view of one of the inner nozzles of the processing unit illustrating the drain through which processing fluid returns to the sump tank for that particular processing unit.

Referring back to FIGS. 3, 4 and 6, processing fluid is exhausted from chamber 42 by a pair of drains 66,67 provided in inner nozzles 48,56. FIG. 6 illustrates only one of the inner nozzles, it being understood that the other inner nozzle is substantially identical. Preferably, as illustrated, the drains 66,67 are located substantially midway between the outlets 53,61 (see FIG. 4). The drains 66,67 each comprise at least one opening 68 provided in the substantially flat surface of its associated inner nozzle. In the particular embodiment illustrated, drains 66,67 each comprise a plurality of aligned slots disposed at an angle $\alpha$ with respect to the direction of processing fluid flow (as indicated by arrow 69 in FIG. 6) across the inner nozzles. However, the drains may comprise any number of openings having any desired configuration.

Conduits or passageways 70,72 are formed between the inner nozzles 48,56 and tanks 30,32, respectively, for exhausting the processing fluid 22 from the chamber 42. The conduits 70,72 terminate in outlets 76,78 for emptying the processing fluid to the sump tank 22. The conduits 70,72 are preferably configured such that the outlets 76,78 are positioned at substantially the same level so that equal back pressure is experienced at the drains 66,67. This is described in greater detail in a copending commonly assigned patent application which was filed concurrently with this application entitled "Apparatus For Processing Photosensitive Material" of David G. Sherburne and which is hereby incorporated by reference. In the particular embodiment illustrated, equal back pressure is achieved by providing a substantially straight conduit 70 having outlet 76 at first predetermined level or height and providing conduit 72 with a substantially straight horizontal section 77 and a vertical section 79 locating outlet 78 at substantially the same level or height as outlet 76. It is, of course, understood that the particular configuration of conduits may take a variety of other shapes so long as the outlets remains at substantially the same level.

A pair of weirs 91 are provided adjacent the outlets 76,78 for receiving the processing fluid. Each of the weirs 91 includes a wall 82 having an upper edge 97 which is adjacent the outlets 76,78 and an opening 86 in the bottom for allowing fluid to return to the sump tank 34. In the particular embodiment illustrated, the weirs 91 each have a substantially rectangular configuration and is sized such that the opening 86 is substantially always below the top of the fluid in sump tank 23. The size of opening 86 is selected such that the fluid 22 in the weir 91 during operation of the processing unit will be just below the upper edge 97 so as to minimize the formation of bubbles is in the processing fluid and thereby reduce its effectiveness.

A pump 84 is used to draw processing fluid 22 from the sump tank 23 into the lower input of the lower tank 32. The pump 86 causes the processing fluid 22 to go into the lower chamber 33, which in turn causes the processing fluid 22 to go into vertical tubes 34 so that processing fluid 22 will fill the upper tank 30. This will cause processing fluid 22 to fill both the upper and lower tanks 30,32 such that substantially equal fluid pressure is applied to the outlets 53,61 at the entrance 44 and exit 46 of the chamber 42.

As is well known in the art, various other modifications may be made to the processing unit as is customary. For example, in the particular embodiment illustrated, a heat exchanger 98 is provided for cooling of the processing fluid. Additionally, a heater 137 may also be provided for also heating of the processing fluid where necessary. While the drawings illustrate the pump being located outside of the sump tank, it could equally be located within the sump tank if desired. Additionally, appropriate connections may be provided for connecting of the sump tank to the pump and to the lower tank 32 by suitable means.

The present invention provides an apparatus for processing photosensitive material which utilizes a long narrow discharge opening for providing a thin layer of a processing fluid on a photosensitive material. The present invention also allows the use of non rigid materials, such as plastic, for forming the parts which form the discharge openings and thereby utilize low cost manufacturing techniques and materials. The parts that form the discharge opening are designed to provide a substantially uniform fluid steam along the entire length of the discharge opening. Additionally the processor is easy to manufacture, and assemble or disassemble.

The invention has been described in detail with particular reference to a preferred embodiment thereof, but it will be understood that variations and modifications can be made without departing from the scope of the present invention. The present invention being limited by the following claims.

We claim:

1. In an apparatus for processing photosensitive material, the apparatus having an upper tank for a processing fluid and a lower tank for the processing fluid, an narrow processing chamber between the upper tank and lower thanks through which the photosensitive material can be advanced for processing the photosensitive material, said chamber having an entrance at one end and an exit at the other end to allow the photosensitive material to travel through the chamber, a first nozzle assembly for supplying processing fluid from the upper tank to the processing chamber, said first nozzle assembly comprising and an inner nozzle mounted to the upper tank and at least one outer nozzle secured to said upper tank, said inner and at least one outer nozzle being spaced apart a predetermined distance so as to form a discharge opening there between, said discharge opening being in fluid communication with the processing fluid in said upper tank so as to create a first fluid layer on one side of the photosensitive material, a first drain for removing processing fluid from the first fluid layer, a second nozzle assembly for supplying processing fluid from the lower tank to the processing chamber, said second nozzle assembly comprising an inner nozzle mounted to the lower tank and at least one outer nozzle secured to the lower tank, said inner and at least one outer nozzle of said second nozzle assembly being spaced apart a predetermined distance so as to form a discharge opening there between, said discharge opening being in fluid communication with the processing fluid in said lower tank so as to create a second fluid layer on the other side of the photosensitive material, a second drain for removing processing fluid from the second fluid layer, the improvement comprising;

said inner nozzles and at least one outer nozzles of said first and second nozzle assemblies being made of a plastic material, and means for maintaining said predetermined distance between said inner and outer nozzles substantially constant along the length of the discharge opening comprises a plurality of spaced projections of substantially identical thickness between said inner and at least one outer nozzles.

2. In an apparatus according to claim 1 said apparatus further comprises means coupling the tanks together so that processing fluid can flow freely between the lower and upper tanks.

3. In an apparatus according to claim 1 wherein a pair of outer nozzles are provide for said first and second nozzle assemblies so as to provide a pair of discharge openings for each of said nozzle assemblies.

4. In a apparatus according to claim 3 wherein said pair of discharge openings for each of said assemblies are located such that one opening is located at the entrance and the other is located at the exit.

5. In an apparatus according to claim 1 wherein said means for maintaining said predetermined distance between said inner and outer nozzles substantially constant along the length of the discharge opening further comprises means for preventing rotation of the at least one outer nozzle with respect to the inner nozzle.

6. In an apparatus according to claim 1 wherein said plurality of spaced projections are integrally formed as a part of the at least one outer nozzle.

7. In an apparatus according to claim 5 wherein said means for preventing rotation of said at least one outer nozzle with respect to the inner nozzle comprises a projection formed on said inner nozzle which engages a mating recess formed in said at least outer nozzle.

8. In an apparatus according to claim 5 wherein said at least one outer nozzle is removably mounted to said tank.

9. In an apparatus according to claim 5 wherein said at least one outer nozzle is removably mounted to said tank by projections which snap fit in corresponding openings provided in the tank.

10. In an apparatus according to claim 1 wherein the inner nozzle of said first and second nozzle assemblies are slideably mounted to its associated tank.

11. In an apparatus for processing photosensitive material, the apparatus having a narrow processing chamber through which the material can be advanced for processing the material, said processing chamber having an entrance at one end and an exit at the other end to allow the photosensitive material to travel through the chamber, a tank for holding a processing fluid, a first nozzle assembly for supplying processing fluid from the tank to the processing chamber, said first nozzle assembly comprising an outer nozzle secured to the tank and an inner nozzle mounted to said tank, said inner and outer nozzles being space apart a predetermined distance so as to form a discharge opening therebetween, said discharge opening being in fluid communication with the processing fluid in said tank so as to create a first fluid layer on one side of the photosensitive material passing through the processing chamber; the improvement comprising;

said inner and outer nozzles of said first nozzle assembly being made of a plastic material, and means for maintaining said predetermined distance between said inner and outer nozzles substantially constant along the length of the discharge opening comprising a plurality of spaced projections of substantially identical thickness between said inner and at least one outer nozzles.

12. In an apparatus according to claim 11 wherein said means for maintaining said predetermined distance between said inner and outer nozzles substantially constant along the length of the discharge opening further comprises means for preventing rotation of the outer nozzle with respect to the inner nozzle.

13. In an apparatus according to claim 12 wherein said means for maintaining said predetermined distance between said inner and outer nozzles substantially constant along the length of the discharge opening comprises a plurality of spaced projections of substantially identical thickness between said inner and outer nozzles.

14. In an apparatus according to claim 12 wherein said plurality of spaced projections are integrally formed as a part of the outer nozzle.

15. In an apparatus according to claim 11 wherein said outer nozzle is removably mounted to said tank.

16. In an apparatus according to claim 11 wherein said outer nozzle is removably mounted to said tank by projections which snap fit in corresponding openings provided in the tank.

17. In an apparatus according to claim 11 wherein a compliant material is disposed between the inner nozzle and tank so as to assist in maintaining a substantially constant gap at the discharge opening.

18. In an apparatus for processing photosensitive material, the apparatus having an upper tank for a processing fluid and a lower tank for the processing fluid, an narrow processing chamber between the upper tank and lower thanks through which the material can be advanced for processing the material, said chamber having an entrance at one end and an exit at the other end to allow the photosensitive material to travel through the chamber, a first nozzle assembly at the entrance and exit for supplying processing fluid from the upper to the processing chamber, said first nozzle assembly comprising an outer nozzle mounted to the upper tank and an inner nozzle secured to said upper tank, said inner and outer nozzles being space apart a predetermined distance so as to form a discharge opening there between, said discharge opening being in fluid communication with the processing fluid in said upper tank so as to create a first fluid layer on one side of the photosensitive material, a second nozzle assembly at the entrance and exit for supplying processing fluid from the lower tank to the processing chamber, said second nozzle assembly comprising an outer nozzle mounted to the lower tank and an inner nozzle secured to the lower tank, said inner and outer nozzles of said second nozzle assembly being space apart a predetermined distance so as to form a discharge opening there between, said discharge opening being in fluid communication with the processing fluid in said lower tank so as to create a second fluid layer on the other side of the photosensitive material; the improvement comprising;

said inner and outer nozzles of said first and second nozzle assemblies are made of a plastic material, and means for maintaining said predetermined distance between said inner and outer nozzles substantially constant along the length of the discharge opening comprises a plurality of spaced projections of substantially identical thickness between said inner and at least one outer nozzles.

19. In an apparatus for processing photosensitive material, the apparatus having a processing chamber through which a photosensitive material can be advanced for processing the photosensitive material, said processing chamber having an entrance and an exit to allow the photosensitive material to travel through the chamber, a tank for supplying a processing fluid, at least one nozzle assembly for applying a layer of a processing fluid to the photosensitive material, said at least one nozzle assembly comprising an outer nozzle secured to the tank and an inner nozzle mounted to said tank, said inner and outer nozzles being space apart a predetermined distance so as to form an elongated discharge opening therebetween for passage of processing fluid so as to create a first fluid layer on one side of the photosensitive material passing through the processing chamber; the improvement comprising;

means for allowing relative movement of the inner or outer nozzle with respect to said tank so as to maintain a substantially uniform discharge opening along the length of the discharge opening.

20. In an apparatus according to claim 19 where said inner nozzle is slideably mounted to said tank.

21. In an apparatus according to claim 20 wherein said inner nozzle is slideably mounted to said tank by a pair of spaced parallel sidewalls which form a slot designed to receive the upper end of a sidewall of the tank.

22. In an apparatus for processing photosensitive material, the apparatus having a processing chamber through which a photosensitive material can be advanced for processing the photosensitive material, said processing chamber having an entrance and an exit to allow the photosensitive material to travel through the chamber, a tank for supplying a processing fluid, at least one nozzle assembly for applying a layer of a processing fluid to the photosensitive material, said at least one nozzle assembly comprising an outer nozzle secured to the tank and an inner nozzle mounted to said tank, said inner and outer nozzles being space apart a predetermined distance so as to form an elongated discharge opening therebetween for passage of processing fluid so as to create a first fluid layer on one side of the photosensitive material passing through the processing chamber; the improvement comprising;

said inner and outer nozzles of said first and second nozzle assemblies are made of a non rigid material, and means for maintaining said predetermined distance between said inner and outer nozzles substantially constant along the length of the discharge opening.

23. In an apparatus according to claim 22 wherein said non rigid material is plastic.

24. In an apparatus according to claim 22 wherein said means for maintaining said predetermined distance between said inner and outer nozzles substantially constant along the length of the discharge opening further comprises means for preventing rotation of the at least one outer nozzle with respect to the inner nozzle.

25. In an apparatus according to claim 22 wherein said plurality of spaced projections are integrally formed as a part of the at least one outer nozzle.

26. In an apparatus according to claim 24 wherein said means for preventing rotation of said at least one outer nozzle with respect to the inner nozzle comprises a projection formed on said inner nozzle which engages a mating recess formed in said at least outer nozzle.

27. In an apparatus according to claim 22 wherein said at least one outer nozzle is removably mounted to said tank.

28. In an apparatus according to claim 27 wherein said at least one outer nozzle is removably mounted to said tank by projections which snap fit in corresponding openings provided in the tank.

29. In an apparatus according to claim 22 wherein the inner nozzle of said first and second nozzle assemblies are slideably mounted to its associated tank.

30. In an apparatus for processing photosensitive material, the apparatus having an upper tank for a processing fluid and a lower tank for the processing fluid, an narrow processing chamber between the upper and lower thanks through which the photosensitive material can be advanced for processing the photosensitive material, said chamber having an entrance at one end and an exit at the other end to allow the photosensitive material to travel through the chamber, a first nozzle assembly for supplying processing fluid from the upper tank to the processing chamber, said first nozzle assembly comprising an inner nozzle mounted to the upper tank and at least one outer nozzle secured to said upper tank, said inner and at least one outer nozzle being spaced apart a predetermined distance so as to form a discharge opening there between, said discharge opening being in fluid communication with the processing fluid in said upper tank so as to create a first fluid layer on one side of the photosensitive material, a first drain for removing processing fluid from the first fluid layer, a second nozzle assembly for supplying processing fluid from the lower tank to the processing chamber, said second nozzle assembly comprising an inner nozzle mounted to the lower tank and at least one outer nozzle secured to the lower tank, said inner and at least one outer nozzle of said second nozzle assembly being spaced apart a predetermined distance so as to form a discharge opening there between, said discharge opening being in fluid communication with the processing fluid in said lower tank so as to create a second fluid layer on the other side of the photosensitive material, a second drain for removing processing fluid from the second fluid layer, the improvement comprising;

said inner nozzle and at least one outer nozzles of said first and second nozzle assemblies being made of a plastic material, and means for maintaining said predetermined distance between said inner and outer nozzles substantially constant along the length of the discharge opening further comprises a means for preventing rotation of the at least one outer nozzle with respect to the inner nozzle comprises a projection formed on said inner nozzle which engages a mating recess formed in said at least one outer nozzle.

* * * * *